United States Patent [19]

Stefanos

[11] Patent Number: 5,031,940

[45] Date of Patent: Jul. 16, 1991

[54] WATER SUPPLY ELBOW WITHIN A PLASTIC HOUSING COMPRISING THREE OR MORE PARTS, CONNECTABLE TO PLASTIC CONDUCTORS WITH A PLASTIC SPIRAL COVERING OF VARYING DIAMETERS

[76] Inventor: Kilimis Stefanos, 4 Salaminias St., Rouf II8 55, Athens, Greece

[21] Appl. No.: 235,469

[22] Filed: Aug. 24, 1988

[30] Foreign Application Priority Data

Jul. 22, 1988 [GR] Greece ..... 880200

[51] Int. Cl.[5] ..... F16L 55/00; F16L 43/00

[52] U.S. Cl. ..... 285/45; 285/64; 285/177; 285/179; 285/423

[58] Field of Search ..... 285/179, 45, 61, 64, 285/176, 177, 423

[56] References Cited

U.S. PATENT DOCUMENTS

| | | | |
|---|---|---|---|
| 1,115,696 | 11/1914 | Linbarger | 285/179 |
| 2,117,955 | 5/1938 | Haas | 285/177 |
| 2,200,874 | 5/1940 | Dann | 285/179 |
| 2,440,864 | 5/1948 | Liss | 285/179 |
| 3,606,396 | 9/1971 | Prosdocimo et al. | 285/177 |
| 4,045,060 | 8/1977 | Daigle | 285/179 |
| 4,307,901 | 12/1981 | Orberg et al. | 285/64 |
| 4,461,498 | 7/1984 | Kunsman | 285/179 |
| 4,733,889 | 3/1988 | Haines | 285/179 |
| 4,786,088 | 11/1988 | Ziu | 285/177 |

*Primary Examiner*—Randolph A. Reese
*Assistant Examiner*—Carol I. Bordas

[57] ABSTRACT

The present invention proposes a water supply elbow with a plastic housing, suitable for connections with flexible plastic conductors of hydraulic installations of water supply networks and of central heating and air-conditioning networks with the conventional water taps, radiator valves and other commercially available accessories, where mainly built into the walls and/or laid underneath the floor the abovementioned flexible plastic conductors are covered by an external spiral coating. The basic charactertistics of the proposed water supply elbow with a plastic housing are its manufacturing three or more parts which allow for passing through the end cylindrical portion (3) of spiral coverings of the flexible plastic conductors of varying diameters, the simple and economical construction of the generally semicylindrical basement (1) and the generally semicylindrical covering (2) which is mutually engaged by mere contact, the bottom end provided with an internal recession suitable for fitting the third cylindrical part (3) of the housing via tightening through screwing within the holes (18*a,b,c*) provided onto side flanges (19*a,b,c*) either of the two parts (1) and (2) or of all three parts (1), (2) and (3) of the housing.

1 Claim, 6 Drawing Sheets

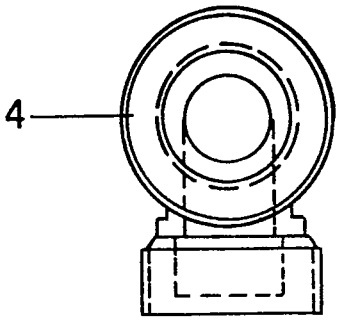
FIG.11
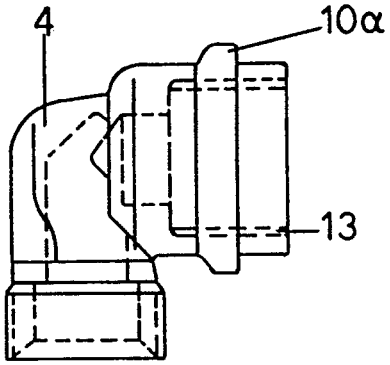
FIG.12
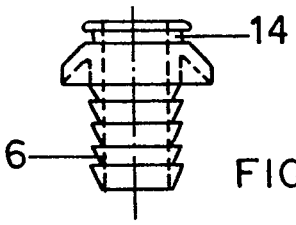
FIG.13
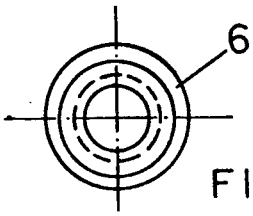
FIG.14
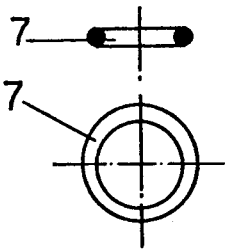
FIG.16
FIG.15
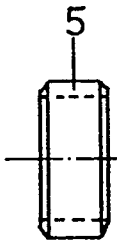
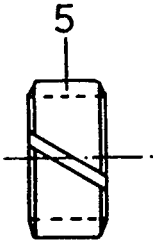
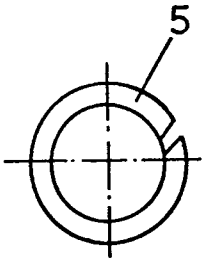
FIG.17 FIG.18 FIG.19

FIG 20
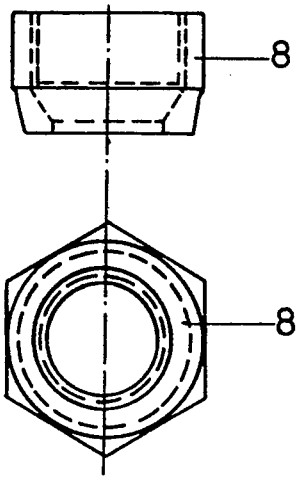
FIG. 21
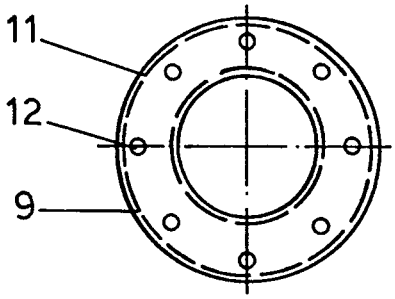
FIG. 23
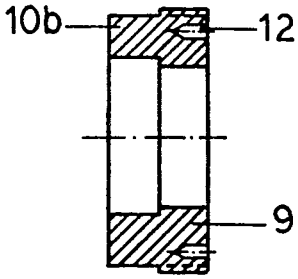
FIG. 22
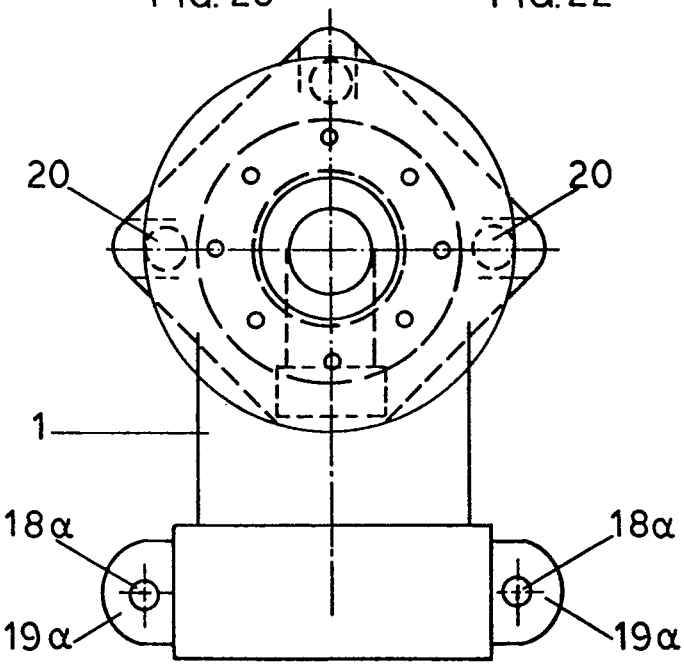
FIG. 24

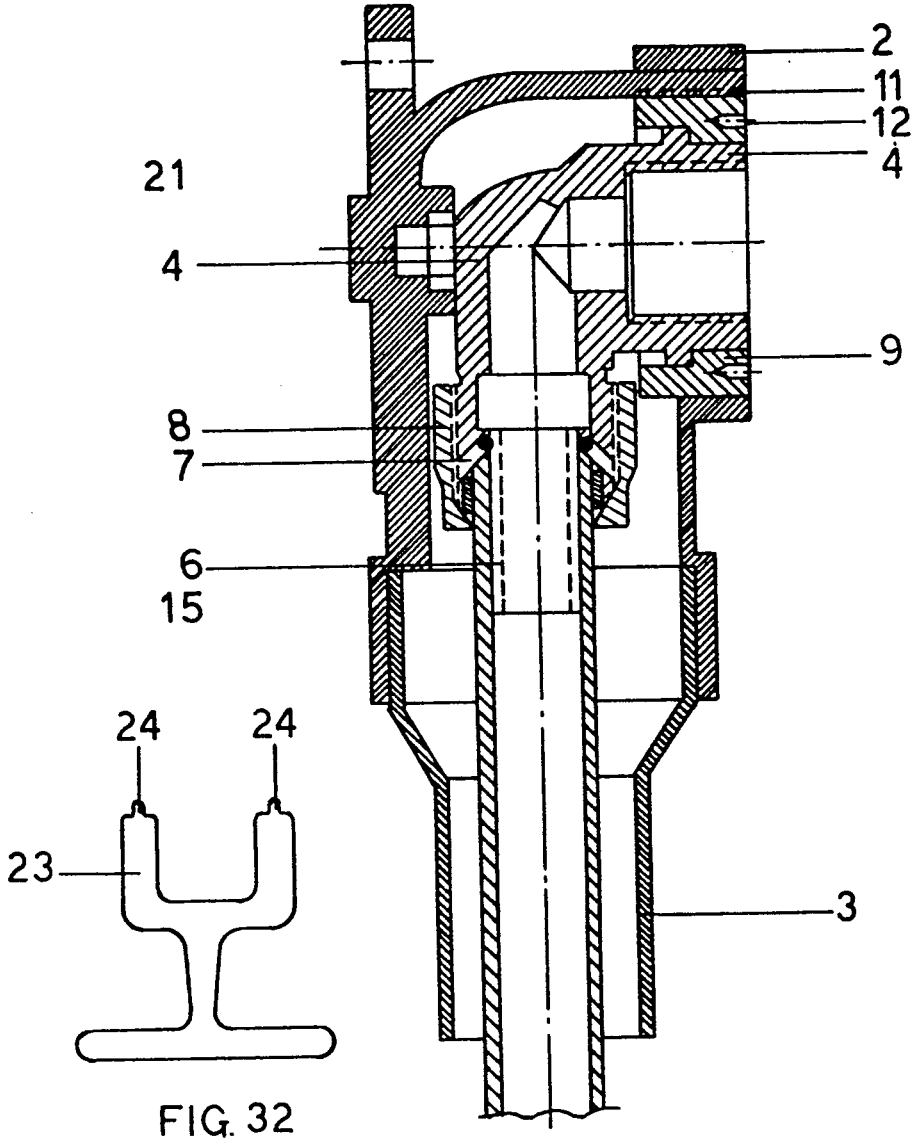
FIG. 32
FIG. 29
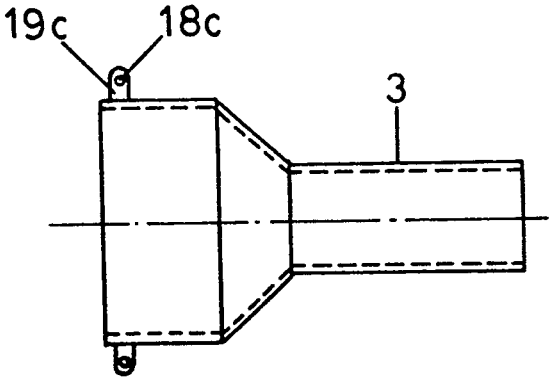
FIG. 30
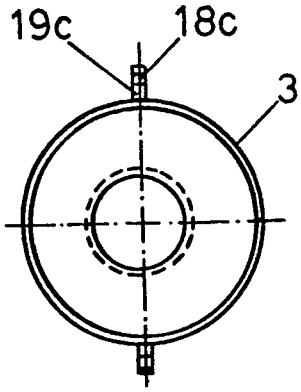
FIG. 31

WATER SUPPLY ELBOW WITHIN A PLASTIC HOUSING COMPRISING THREE OR MORE PARTS, CONNECTABLE TO PLASTIC CONDUCTORS WITH A PLASTIC SPIRAL COVERING OF VARYING DIAMETERS

THE BACKGROUND OF THE INVENTION

The present invention relates to the field of the art of connecting fittings in water supply networks in general and in particular to the field of connecting fittings suitable for flexible plastic conductors of water supply networks and hydraulic installations in general.

The broad circulation of flexible plastic conductors for hydraulic installations in water supply networks and in central heating and air-conditioning networks as well, has created the need for the development of new connecting fittings of the said conductors to the conventional commercially available water taps or radiator valves. The coating of the said plastic conductors with another spiral type covering conductor is necessary, so as to enable when required replacement of a portion of the plastic conductor which presents a malfunction with another new portion of plastic conductor, capable of passing through the same permanently installed spiral-type covering conductor. In this way repair or replacement of parts in the network becomes possible without costly repair work.

It was henceforth necessary to produce couplings, elbows, etc. by means of which one would be able to connect the conventional water supply, radiator valves, etc. to the shorter diameters of flexible plastic conductors.

In order to ensure the inspection and replacement of portions of the flexible plastic conductors which are contained within the spiral type covering conductors, it became necessary to mount the said couplings, elbows, etc. within an independent plastic housing, where this housing is built into the wall with a free end left for the connection to the metallic tap, valve, etc. The metallic couplings, elbows, etc. are sufficiently protected from corrosion, enclosed within the said plastic housing.

By way of example such a plastic housing has developed in order to house a metallic water supply elbow. The practical experience of such plastic housings of water supply elbows comprising a single, solid or a couple of pieces has presented certain disadvantages, relating to the facility of performing the necessary connections on the one hand to the flexible plastic conductor with the spiral covering and on the other hand to the metallic water tap or valve. The process of disconnecting, if necessary, is even more difficult. A disadvantage of the above plastic housings for water supply elbows of the prior art is that because of their construction in one single or two pieces allow only for the connection and usage with a certain maximum diameter of the spiral covering conductor and this necessitates the provision of plastic housings of different dimensions to cover for spiral coverings of different diameters. Furthermore if for a two-piece housing, one piece is pressed against the other in order to afford their connection, the cost of manufacturing is higher since such a connecting process involves materials with a desired increased elasticity and it further involves restricted manufacturing tolerances. Furthermore, such a fitting process of pressing one piece of the plastic housing against the other, results in the assembly and most particularly the dismantling of the housing becoming difficult because of the relatively high stresses developed, which are difficult to handle manually. Such a process does further result to noise.

Another disadvantage of such plastic housings for metallic water supply elbows of the prior art relates to the dimensions and in particular the internal length and diameter within which the water supply elbow moves and has to be pulled out when it is required to change a portion of the flexible conductor. As time goes by, the plastic conductor generally suffers from a hardening process leading to a respective loss of flexibility. The plastic conductor may furthermore develop serpentine fluctuations, resulting to further diffuculties in its smooth pulling out. It is for the above stated reasons that it is of special importance to facilitate movement of both the metallic water supply elbow and the plastic conductor by providing the maximum possible internal dimensions of length and diameter and by freeing the interior of the housing from ribs and other formations that may obstruct such movement.

An object of the present invention is to efficiently overcome the above disadvantages and drawbacks of the prior art, providing a water supply elbow within a plastic housing comprising three or more parts, which is thereby suitable for connection to plastic conductors with a plastic spiral covering of varying diameters, which is of very simple and economical construction, substantially facilitating the process of assembly and dismantling of all kinds of water supply elbows, subjectable to minimal operational stresses and thereby presenting a high strength and long service life.

Another object of the present invention is to provide the metallic water supply elbow with changeable fitting accessories to flexible plastic conductors, so that it may be easy to change defective fitting accessories as well as to use the same main body of the metallic water supply elbow with flexible plastic conductors of varying diameters.

These and other objects, characteristics and advantages of the proposed water supply elbow with a plastic housing comprising three or more parts, connectable to plastic conductors with a spiral covering of varying diameters will become apparent in the following analytical description of the invention.

BRIEF DESCRIPTION OF THE DRAWINGS

The present invention will be clearly understood by those skilled in the art with reference to the accompanying drawings, which depict in an illustrative manner preferred embodiments of the invention.

FIG. 11 shows a plan view of the main body of the water supply elbow.

FIG. 12 shows a side view of the main body of the water supply elbow.

FIG. 13 shows a front view of the connection accessory of FIG. 8.

FIG. 14 shows a plan view of the connection accessory of FIG. 8.

FIG. 15 shows a plan view of the rubber tightness ring mounted around the circumference of the lips at the basement of the connection accessory of FIG. 8.

FIG. 16 shows a front view of the rubber tightness ring.

FIG. 17 shows one side view of the biconical metallic connection ring depicted in FIG. 9.

FIG. 18 shows another side view of the biconical metallic connection ring of FIG. 9.

FIG. 19 shows a plan view of the biconical metallic connection ring of FIG. 9.

FIG. 20 shows a front view of the nut connecting the water supply elbow to the flexible plastic conductor depicted in FIG. 10.

FIG. 21 shows a plan view of the nut depicted in FIG. 10.

FIG. 22 shows a side view of the plastic ring depicted in FIG. 6.

FIG. 23 shows a plan view of the plastic ring depicted in FIG. 6.

FIG. 24 shows a view of the rear surface of the basement portion of the proposed plastic housing.

FIG. 29 shows a longitudinal cross sectional view of the water supply elbow within the proposed plastic housing, connected to a plastic conductor.

FIG. 30 shows the side view of an alternative embodiment of the end tubular portion being provided with perforated side flanges, suitable for a simultaneous connection with the other two pieces of the plastic housing.

FIG. 31 shows the plan view of the alternative embodiment of the end tubular portion of FIG. 30.

FIG. 32 shows a front view of the key used to screw the plastic ring fixedly supporting the supply opening of the water supply elbow within the plastic housing.

Figure 1:
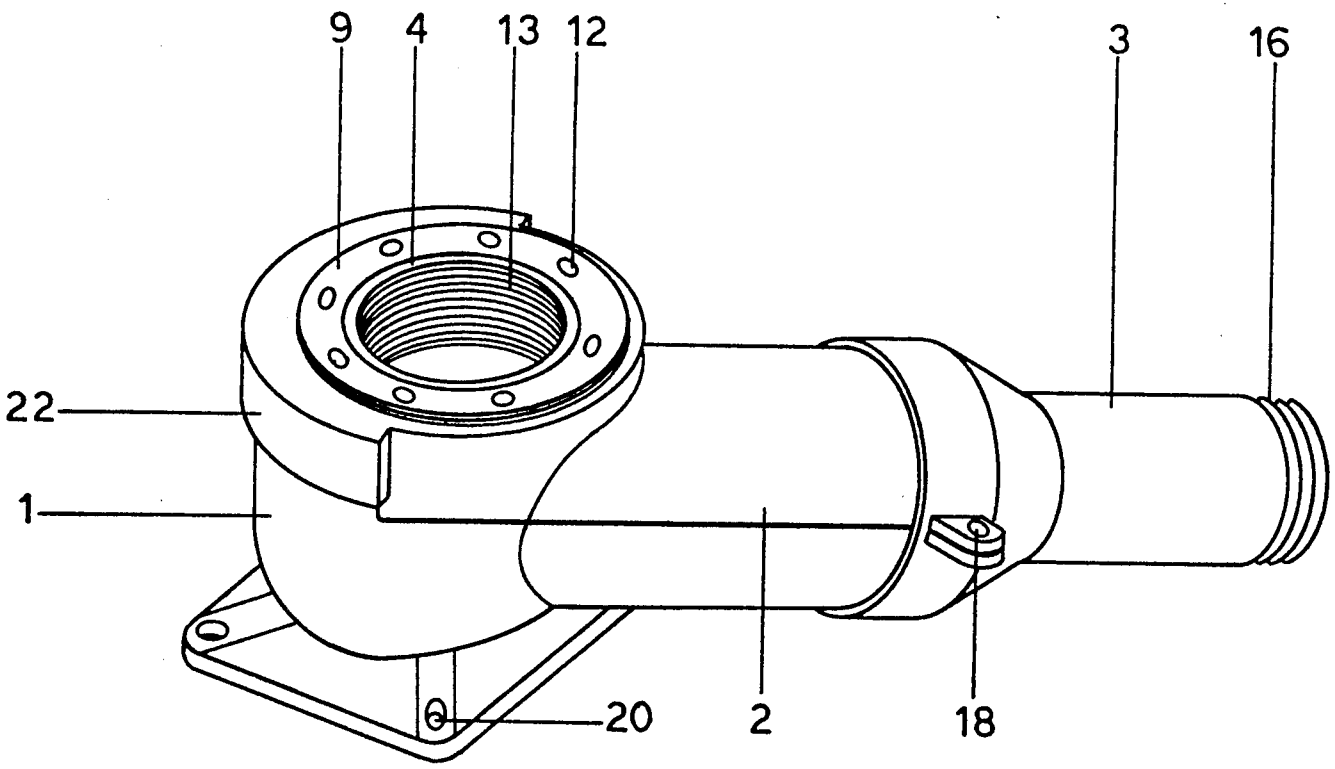
FIG. 1 presents a perspective sketch of an assembled water supply elbow within a plastic housing comprising four parts in accordance to the invention, connected to a plastic conductor with a plastic spiral covering.
Figures 2, 3, 4, 5, 6:
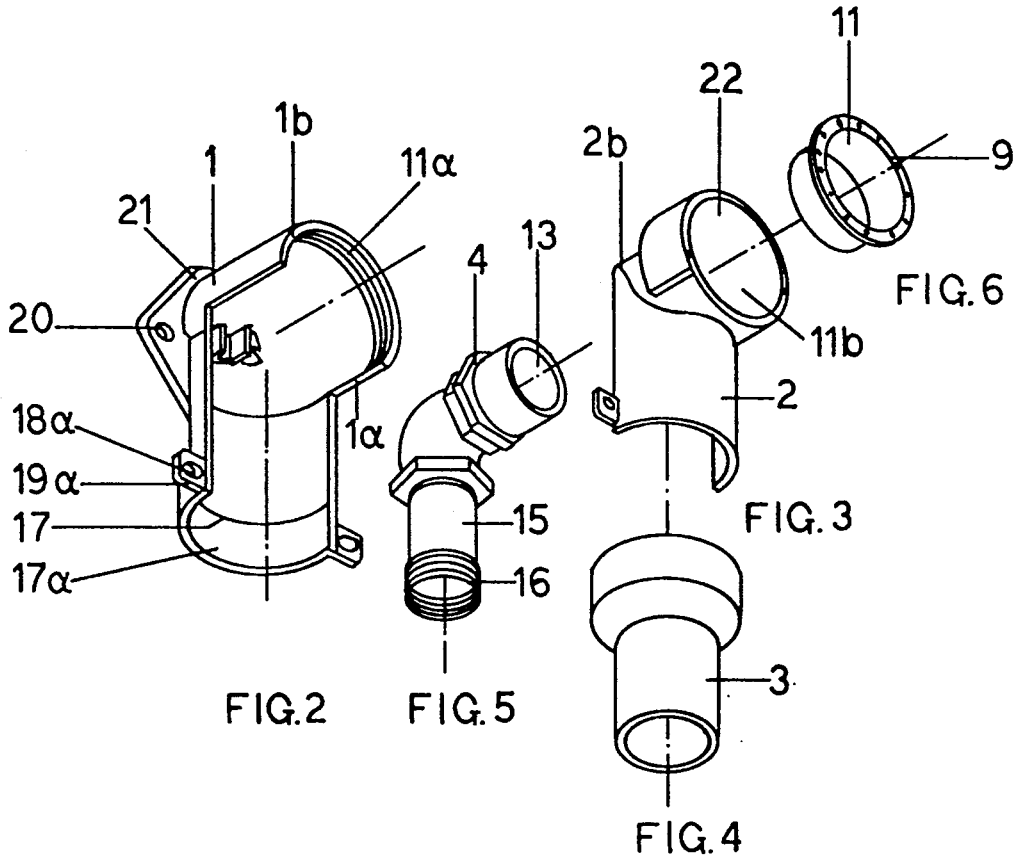
FIG. 2 shows a perspective sketch of the basement part in the plastic housing of the invention.
FIG. 3 shows a perspective sketch of the covering of the plastic housing of the invention.
FIG. 4 shows a perspective sketch of the tubular end portion of the plastic housing of the invention.
FIG. 5 shows a perspective sketch of the metallic water supply elbow, properly assembled and connected to the flexible plastic conductor covered by a plastic spiral covering.
FIG. 6 shows a perspective sketch of the plastic ring which is in accordance to the invention used to support via bolting the metallic water supply elbow within the plastic housing.
Figures 7, 8, 9, 10:
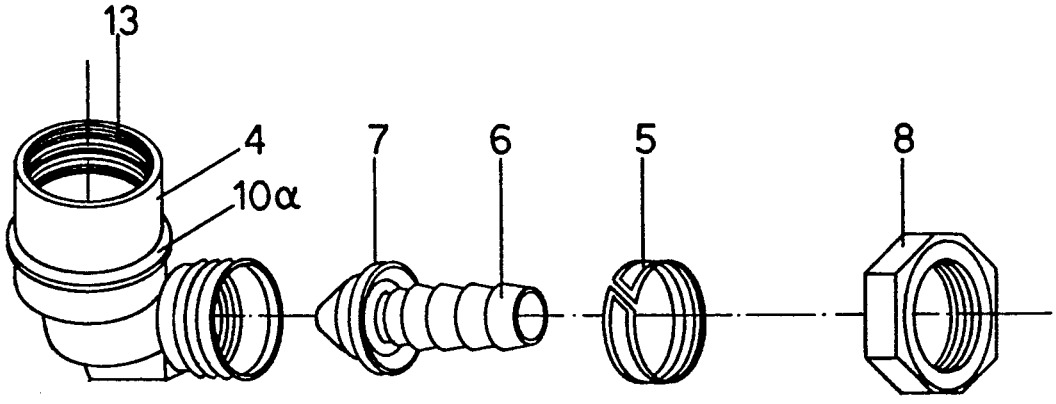
FIG. 7 shows a perspective sketch of the main body of the metallic water supply elbow.
FIG. 8 shows a perspective sketch of a connection accessory of the main body of the water supply elbow to the flexible plastic conductor.
FIG. 9 shows a perspective sketch of the metallic biconical connecting ring of the water supply elbow to the flexible plastic conductor.
FIG. 10 shows a perspective sketch of the nut used for tightening the main body of the water supply elbow to the flexible plastic conductor.
Figure 25:
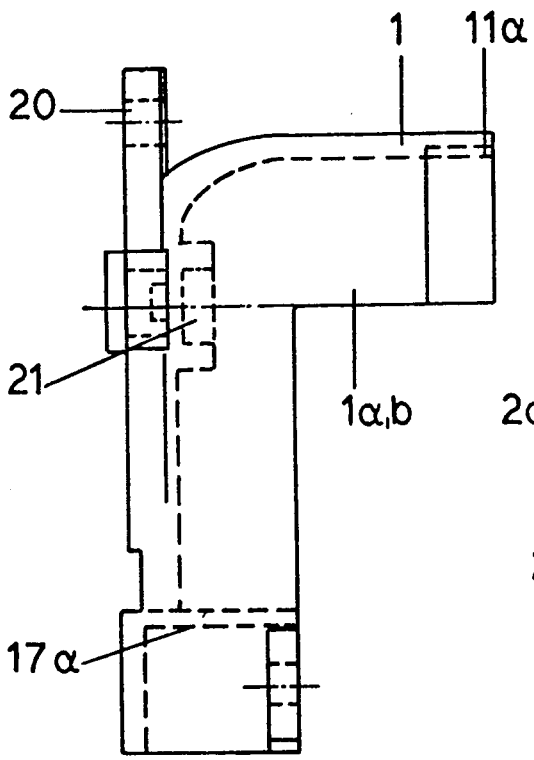
FIG. 25 shows a side view of the basement portion of the proposed plastic housing.
Figure 26:
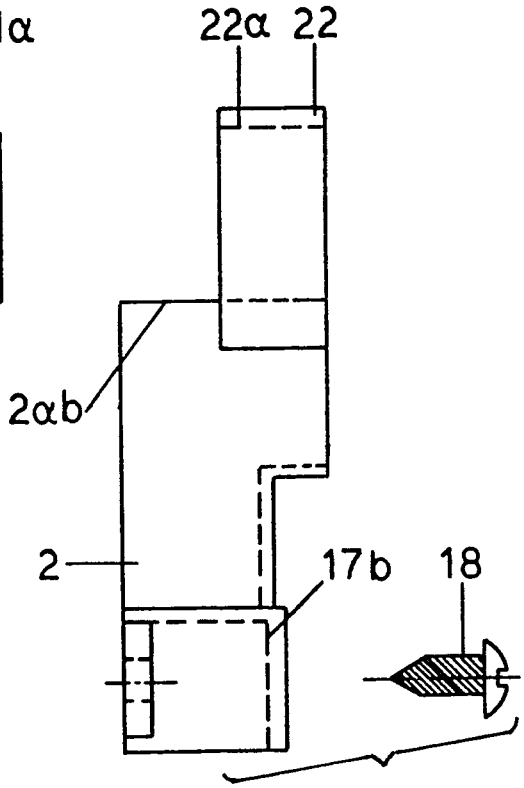
FIG. 26 shows a side view of the covering portion of the proposed plastic housing and of the bolt used to screw together the two or three parts of the plastic housing.
Figure 27:
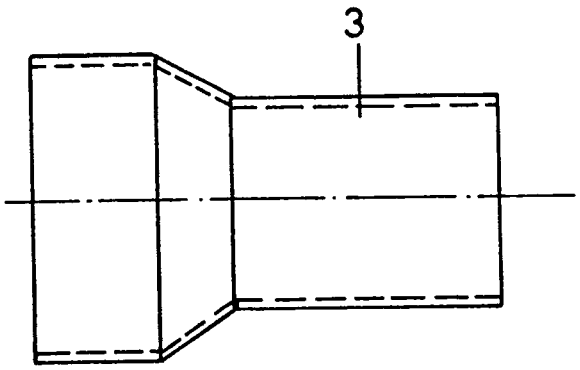
FIG. 27 shows a side view of the end tubular portion of the plastic housing, depicted in FIG. 4.
Figure 28:
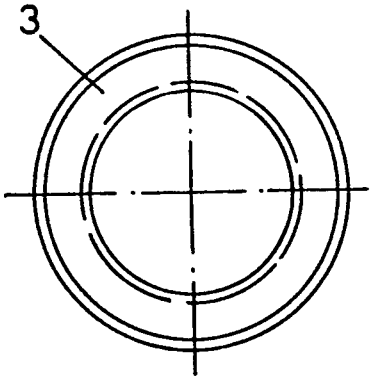
FIG. 28 shows a plan view of the end tubular portion depicted in FIG. 4.

The various component parts and accessories of the proposed water supply elbow enclosed within a plastic housing comprising four parts as depicted in the drawings, are listed below in an order of numbering, corresponding to their numbering in the accompanying drawings:

1. Basement part of the plastic housing.

1*a, b*; Vertical lip sections of basement 1, fittable via sliding along the corresponding lip sections 2*a, b* of covering 2.

2. Covering of the plastic housing

2*a, b* Vertical lip sections of covering 2, fittable via sliding along the corresponding lip sections 1*a, b* of basement 1.

3. Tubular end portion of the plastic housing.

4. Main body of the water supply elbow.

5. Metallic biconical connecting ring of the water supply elbow to the flexible plastic conductor.

6. Connection accessory of the main body of the water supply elbow to the flexible plastic conductor.

7. Rubber tightness ring.

8. Nut for tightening the main body of the water supply elbow to the flexible plastic conductor.

9. Plastic ring fixedly supporting via bolting the water supply elbow onto the plastic housing.

10*a*. Recession at the end of the plastic housing for connection to a commercially available tap or valve

10*b*. Circumferential recession in the interior of the plastic ring 9 onto which the circumferential recession 10*a* of the water supply elbow is mounted.

11. Exterior threading of the plastic stabilizing ring 9

11*a*. Semi-circumference of the basement 1 of the plastic housing, provided with an internal threading, corresponding to the exterior threading of the ring 9.

11*b*. Semi-circumference of the covering 2 of the plastic housing, provided with an internal threading, corresponding to the exterior threading of the ring 9.

12. Series of circumferential opening-holes for screw driving ring 9.

13. Internal threading of the end of the water supply elbow for the connection to a commercially available water tap or valve.

14. Circumferential recession of connection accessory 6, whereat the rubber tightness ring 7 is fitted.

15. Flexible plastic conductor.

16. Plastic spiral covering of the flexible plastic conductor.

17*a*. Recession of the semi-circular bottom ending of the basement 1 of the plastic housing.

17*b*. Recession of the semi-circular bottom ending of the covering 2 of the plastic housing.

18. Bolts for scewing together the two or three parts of the plastic housing.

18*a, b, c*; Holes provided onto side flanges of parts 1, 2 and 3 respectively of the plastic housing, via which pass the bolts 18.

19*a, b, c*; Side Flanges of parts 1, 2 and 3 respectively of the plastic housing.

20. Holes for bolting the rear flat portion of the basement 1 of the plastic housing.

21. Formation in the interior of the basement 1, whereupon the water supply elbow is fitted.

22. Semicircular annulus-extension of the upper semicircular ending with the internal threading 11*b* of the covering 2.

23. Bolting key of the plastic ring 9.

24. Endings of the side members of the key 23 introduced into anti-diametrically arranged pair of openings-holes 12 of plastic ring 9.

ANALYTICAL DESCRIPTION OF THE INVENTION

Referring now to the accompanying drawings, we will describe certain illustrative, preferred embodiments of the invention.

In accordance to a preferred embodiment of the invention, the plastic housing within which seats the metallic water supply elbow, connected to the chosen flexible plastic conductor of hydraulic installations, generally has a cylindrical shape and comprises two semi-cylindrical parts, namely one basement 1 and one corresponding covering 2. The basement 1 and the covering 2 when assembled provide the generally cylindrical total view of the housing and a first characteristic of such a housing is that the assemblying process is effected easily, without creating any noise and without any special effort. The basement 1 extends to an upper semi-circular portion with an internal threading 11*a*, which extends normally to the generally longitudinal semi-circular body of the basement 1, whereas downwards the basement 1 extends to a semi-circle with an internally shaped recession 17*a*. The covering 2 on the other hand extends upwards to a semi-circular portion with an internal threading 11*b*, also provided normally in the extension of the generally longitudinal semi-cylindrical body of the covering 2. The fitting of the covering 2 onto the basement 1 is made by mere contacting and mutually sliding of a couple of points of the vertical lip sections 1*a* and 1*b* of the basement 1 to a corresponding couple of points of the vertical lip sections 2*a* and 2*b* of the covering 2, whereby the semi-cylindrical surface of the basement 1 fully seats onto the corresponding semicylindrical surface of the covering 2.

Following the assemblying of the covering 2 onto the basement 1 of the plastic housing, the introduction of the metallic water supply elbow and its connection to the flexible plastic conductor 15 with the plastic spriral covering 16, the upper, now complete circular ending with the internal treading 11*a, b* of the housing, is covered by bolting the plastic ring 9 with the corresponding external threading 11. In order to ensure strength in the tightening and eventual stabilizing with the plastic ring 9, the upper semi-circular ending with the internal threading 11*b* of covering 2 extends to a semicircular or larger than a semicircle or complete circular annulus 22, which following the assemblying of the covering 2 onto the basement 1 of the housing surrounds the upper semicircular ending with the internal threading 11*a* of the basement 1. The end of the main body 4 of the metallic water supply elbow extends through the central opening of the ring 9 and is provided with an internal threading 13, suitable for connection to a commercially available tap or valve accessory. Furthermore, the ring 9 is internally formed so as to comprise a circumferential recession 10*b*, onto which fits a corresponding circumferential recession 10*a* at the end of the main body 4 of the water supply elbow. Finally the ring 9 is provided with a series of circumferential, preferably circular openings-holds 12, whereby via a special metallic key 23 depicted in FIG. 15 with two side-members 24, introducable to any antidiametrically arranged couple of openings-holes 12, a clockwise or counter-clockwise torque is exerted in order to screw or unscrew the plastic ring 9 and stabilize or remove the metallic water supply elbow. The abovementioned openings-holes 12 of the ring 9 are preferably of circular or square or other desired shape, whereby the endings of side members 24 of the key 23 take a corresponding form.

The bottom semicircular endings of the generally semicylindrical portions of the basement 1 and the covering 2 of the plastic housing are provided with an internal semicircular recession 17*a* and 17*b* respectively, whereby the end portion 3 of the plastic housing fits within the thereby formed circular ending with the internal recession 17*a, b* of the assembled plastic housing. Following its stabilization within the above mentioned recession, the end portion 3 subsequently converges to a longitudinal cylindrical portion of a smaller diameter corresponding to the diameter of the spiral covering 16 of the flexible plastic conductor 15. Thus, an end portion 3 with a bottom cylindrical ending of a diameter corresponding to the diameter of the spiral covering employed, may consecutively be used with the same plastic housing. The covering 2 and basement 1 are provided onto their bottom semi-cylindrical extensions with a pair of antidiametrically arranged side flanges 19*a* and 19*b* respectively, which are perforated with concentric corresponding holes 18*a* and 18*b*. The eventual bottom assemblying of the two portions 1 and 2 of the plastic housing, following the fitting of the third part 3 within the circular formed recession 17*a, b*, is implemented by bolting the two pieces together through the bolts 18.

A characteristic feature of the proposed plastic housing is the exploitation of the maximum, possibly available by the thickness of the walls whereat it is inbuilt, dimensions and thereby free space for the movement on the one hand of the metallic elbow and on the other hand of the plastic conductor which has to be pulled out. The abovementioned free space is fully free from nerves and other formations which could possibly obstruct the movement and has a preferred diameter ranging from 34–40 mm and a preferred length from the end of the formation-seat 21 of the metallic water supply elbow onto the basement 1 up to the point, where the contraction of diameter starts for the reception of the spiral covering, of the order of 45–55 mm. A preferred industrial model of the abovementioned plastic housing has been made with an internal diameter of 38 mm and length from the end of the formation-seat 21 up to the point of contraction of the diameter of 50 mm.

In accordance to an alternative embodiment of the invention as depicted in FIG. 14, the end portion 3 of the plastic housing is also provided with a pair of antidiametrically arranged side flanges 19*c* onto its upper ending, provided with central holes 18*c*, whereby all three portions 1, 2 and 3 are joined together via the bolts 18.

The metallic water supply elbow is preferably made from brass, ilustratively in accordance to DIN 17660, and as shown in the accompanying drawings comprises a main body 4, a connection accessory 6 with a tightness ring 7 seated onto a circumferential recession 14 of the upper part of the connection fitting 6, a metallic biconical ring 5 and a tightening nut 8 by means of which the main body 4 of the water supply elbow is connected to the flexible plastic conductor 15.

A characteristic feature of the above described water supply elbow is the independent provision of the connection accessory 6, which allows for the reception of plastic conductors of varying diameters in the same main body 4 of the water supply elbow.

It must hereby be noted that the description of the present invention was made by reference to merely, illustrative embodiments and is not limited hereby. Thus any change or amendment relating to the sizes, dimensions, shape, materials and accessories used in the construction and assemblying process, variety of colours, etc., as long as they do not comprise a new inventive step and do not contribute towards technical development of the state of the art are hereby considered to be part of the scope and the aims of the present invention.

I claim:

1. A plastic housing for a metallic water supply elbow comprising a first basement portion and a second covering portion, said first and second portions forming a housing when assembled of generally cylindrical cross-section, said first and second portions can be separated for the easy introduction or removal of said metallic water supply elbow, with the upper end of said metallic water supply elbow connected to a conventional water tap, radiator valve or other commercially available accessory and the bottom end of the elbow is connected to a flexible plastic conductor having a plastic spiral covering, a third generally cylindrical portion is provided at the bottom end of the housing to allow connection of various diameters of said plastic spiral covering of said conductor to the assembled plastic housing, and a fourth annular connection ring, said annular connection ring is provided with an external thread for threading into an upper circular opening having a corresponding internal thread, said first basement portion and said second covering portion forming when assembled said upper circular opening, said annular connection ring is also provided with an inner circumferential recess which fits onto a corresponding circumferential recess at the upper end of said metallic water supply elbow.

* * * * *